United States Patent [19]

Tsai

[11] Patent Number: 4,585,565

[45] Date of Patent: Apr. 29, 1986

[54] METALWORKING LUBRICANT COMPRISING MINERAL OIL AND ALKOXYALKYL ESTER

[75] Inventor: Mei-Yuan Tsai, Murrysville, Pa.

[73] Assignee: Aluminum Company of America, Pittsburgh, Pa.

[21] Appl. No.: 674,286

[22] Filed: Nov. 23, 1984

[51] Int. Cl.[4] ..... C10M 1/06

[52] U.S. Cl. ..... 252/49.5; 252/56 R

[58] Field of Search ..... 252/49.5 R, 49.5, 56 R

[56] References Cited

U.S. PATENT DOCUMENTS

| | | | |
|---|---|---|---|
| 2,866,758 | 12/1958 | Newman et al. | 252/57 |
| 3,364,143 | 1/1968 | Johnson | 252/49.5 |
| 3,773,668 | 11/1973 | Denis et al. | 252/56 |
| 4,303,738 | 12/1981 | Gini et al. | 252/56 R |
| 4,438,005 | 3/1984 | Zoleski et al. | 252/56 R |

OTHER PUBLICATIONS

Stepan Company Technical Data Sheet, Aug. 8, 1984.

*Primary Examiner*—Y. Harris-Smith

*Attorney, Agent, or Firm*—Glenn E. Klepac

[57] ABSTRACT

A lubricant composition comprising a major proportion of mineral oil and a minor proportion of an alkoxyalkyl ester having the general formula $R_2COO(CH_2CH_2O)_nR_1$ wherein n=1 or 2, $R_1$ is a $C_1$ to $C_8$ alkyl group and $R_2$ is a $C_7$ to $C_{19}$ alkyl or alkenyl group. A particularly preferred composition comprises about 30 wt % butoxyethyl stearate dissolved in about 70 wt % mineral oil.

A metalworking lubricant emulsion is formed by emulsifying about 2–10 wt % of the composition in about 90–98 wt % water. A particularly preferred emulsion comprises about 5 wt % of the composition in about 95 wt % water. The emulsion is suitable for hot rolling and cold rolling aluminum and aluminum alloys.

20 Claims, No Drawings

METALWORKING LUBRICANT COMPRISING MINERAL OIL AND ALKOXYALKYL ESTER

BACKGROUND OF THE INVENTION

The present invention relates to lubricant compositions and more specifically to lubricant emulsions comprising mineral oil and water that are suitable for use in metalworking operations such as the cold rolling and hot rolling of aluminum and aluminum alloys.

In the rolling of metals such as aluminum and aluminum alloys, it is customary to flood the rolls and the workpiece with a coolant in order to carry away heat generated by the operation. It is also customary to use as a coolant an emulsion comprising water, mineral oil and various additives having load bearing and friction-modifying properties for reducing friction between the rolls and workpiece. In order to perform satisfactorily in industry, the lubricant fluid must meet several important requirements.

Among the requirements for a satisfactory metalworking lubricant are corrosion-inhibiting properties and stability under operating conditions. In addition, the lubricant should not cause deposits on the rolls and workpiece during the rolling operation. Such deposits result from the drying of fluid and they are difficult to remove. Other important requirements include avoidance of excessive foam formation and an emulsion stability sufficient to wet the tool and workpiece.

Lubricant emulsions containing water and mineral oil are known in the prior art. However, there is a continuing need to improve the performance characteristics of such lubricant emulsions.

It is a principal object of the present invention to provide a lubricant emulsion suitable for metal rolling and having a reduced tendency to form deposits on the rolls and workpiece during the rolling operation in which such emulsion is used.

It is a related object of the invention to provide a mineral oil lubricant composition in which an alkoxyalkyl ester comprises the principal film strength additive.

Additional objects and advantages of the invention will be apparent to persons skilled in the art upon reading the following detailed description.

SUMMARY OF THE INVENTION

In accordance with the present invention, there is provided a lubricant composition comprising a major proportion of mineral oil and a minor proportion of an alkoxyalkyl ester. The ester has the formula $R_2COO(CH_2CH_2O)_nR_1$ wherein n=1 or 2, $R_1$ is a $C_1$ to $C_8$ alkyl group and $R_2$ is a $C_7$ to $C_{19}$ alkyl or alkenyl group.

A metalworking lubricant emulsion is formed by emulsifying about 2–10 wt % of the composition in about 90–98 wt % water. A preferred emulsion comprises about 3–7 wt % of the composition emulsified in about 93–97 wt % water. A particularly preferred emulsion comprises about 5 wt % of the composition in about 95 wt % water.

The lubricant composition comprises about 60–95 wt % mineral oil and about 5–40 wt % ester, usually about 60–80 wt % mineral oil and about 20–40 wt % ester and preferably about 65–75 wt % mineral oil and about 25–35 wt % ester. A particularly preferred composition comprises about 30 wt % ester dissolved in about 70 wt % mineral oil.

In the ester, $R_1$ preferably may be a $C_4$–$C_8$ saturated straight chain alkyl group. The $R_2$ group may preferably be a $C_{11}$–$C_{17}$ straight chain alkyl or alkenyl group and is more preferably a $C_{17}$ saturated alkyl or monounsaturated alkenyl group. Some preferred alkoxyalkyl esters of the invention are butoxyethyl stearate, butoxyethyl oleate, methoxyethyl stearate and methoxyethyl oleate. Butoxyethyl stearate is particularly preferred. Some other suitable esters are as follows: methoxyethoxyethyl octanoate; methoxyethoxyethyl 2-octenoate; methoxyethoxyethyl decanoate; methoxyethoxyethyl 10-undecanoate; methoxyethoxyethyl laurate; methoxyethoxyethyl oleate; methoxyethyl laurate; ethoxyethyl laurate; butoxyethyl laurate; diethoxyethyl laurate; butoxyethoxyethyl laurate; methoxyethyl octanoate; and methoxyethyl 2-octenoate. Such alkoxyalkyl esters typically have acid values less than about 1 mg KOH/g ester.

A particularly preferred emulsion contains essentially no fatty acids, fatty acid esters or soaps.

Alternatively, the lubricant composition may comprise up to about 10 wt % of a $C_8$–$C_{40}$ mono- or dicarboxylic acid, preferably about 0.5–4 wt %. About 3 wt % of a fatty acid is suitable. Some acceptable acids are lauric acid, isostearic acid, oleic acid, palmitic acid, and "dimer acids". The acid may be present in uncombined form or neutralized with a suitable amine, such as triethanolamine.

DESCRIPTION OF A PREFERRED EMBODIMENT

The metalworking lubricant emulsion of the invention has been found useful for metal fabricating operations, including rolling, drawing and ironing and machining of ferrous and non-ferrous metals. The emulsion is especially suitable for the hot rolling and cold rolling of aluminum and aluminum alloys into sheet and foil form.

The term "hot rolling" refers to rolling that takes place at a metal entry temperature of approximately 450°–1000° F. (232°–538° C.) for aluminum alloys. Hot rolling is typically used to reduce slabs of aluminum alloy material that are several inches thick into sheets having a thickness of about ⅛ inch (0.32 cm).

The term "cold rolling" refers to rolling in which metal entry temperature ranges from ambient temperature to about 450° F. (232° C.) for aluminum alloys. Metal entry temperature ordinarily is approximately ambient temperature. Cold rolling is typically used to reduce sheets of aluminum alloy material about ⅛ inch (0.32 cm) thick into lesser thicknesses.

The principal ingredient of the lubricant composition of the invention is mineral oil. Light petroleum oil resulting in a composition having a viscosity of about 3–5 cSt at 40° C. is preferred for cold rolling. A heavier oil should be selected for hot rolling in order to produce a lubricant composition having a viscosity of about 29–76 cSt at 40° C.

The lubricant composition also comprises a minor proportion of an alkoxyalkyl ester having the general formula $R_2COO(CH_2CH_2O)_nR_1$ wherein n=1 or 2, $R_1$ is a $C_1$ to $C_8$ alkyl group and $R_2$ is a $C_7$ to $C_{19}$ alkyl or alkenyl group. Some preferred esters are butoxyethyl stearate, butoxyethyl oleate, methoxyethyl stearate and methoxyethyl oleate. The ester is soluble in the mineral oil and functions as a film strength additive.

Butoxyethyl stearate is a particularly preferred ester. This commercially available ester has a freezing point of 14° C., a boiling point of greater than 200° C. and 11 cp viscosity at 25° C.

The lubricant composition comprises about 5–40 wt % ester, preferably about 25–35 wt %, dissolved in mineral oil. Compositions containing about 30 wt % of the ester dissolved in about 70 wt % mineral oil are particularly preferred.

About 2–10 wt % of the composition described above is emulsified in about 90–98 wt % water to form a metalworking lubricant emulsion.

The oil phase of the emulsion may optionally contain about 0.5–4 wt % of a $C_8$–$C_{40}$ mono- or dicarboxylic acid. Oleic acid, isostearic acid and lauric acid are suitable monocarboxylic acids and dimerized linoleic acid is a suitable dicarboxylic acid. Dimeric fatty acids are commercially available as "dimer acids", usually containing a total of about 32 to 36 carbon atoms. These acids result from the dimerization of polyunsaturated fatty acids containing from 16 to 18 carbon atoms. For example, the term "$C_{16}$–$C_{18}$ dimer acids" refers to a commercially available dimerization product of mixed $C_{16}$–$C_{18}$ polyunsaturated fatty acids.

The fatty acid may be present in the emulsion in free form or it may be combined with a water-soluble alkanolamine. Some suitable alkanolamines are monoethanolamine, diethanolamine, triethanolamine, dimethylethanolamine, diethyl-ethanolamine, amino-ethyl-ethanolamine, methyl-diethanolamine, N-acetyl ethanolamine, phenylethanolamine, phenyldiethanolamine, mono-, di- and triisopropanolamine, and mixtures of any of the foregoing alkanolamines. The preferred alkanolamines are triethanolamine, diethanolamine and ethyldiisopropanolamine. When an alkanolamine is added, it generally constitutes about 0.4–3.5 wt % of the dispersed phase.

The metalworking lubricant emulsion may also include other additives that are desirable under certain conditions. Such additives include biocides, oxidation inhibitors, corrosion inhibitors and surfactants.

Two preferred metalworking lubricant emulsions are described in the following examples.

EXAMPLE 1

Mineral Oil: 70 wt %
Butoxyethyl Stearate: 30 wt %

EXAMPLE 2

Mineral Oil: 77 wt %
Butoxyethyl Stearate: 20 wt %
Oleic Acid: 3 wt %

Compositions of Examples 1 and 2 are each emulsified in water in proportions of about 5 wt % of the composition to about 95 wt % water. The metalworking lubricant emulsion made from the Example 1 composition was tested on a Stanat rolling mill by cold rolling sheets of 1100-0 and 5182-0 aluminum alloy. The Example 1 emulsion was compared with a prior art emulsion containing a fatty acid, a fatty acid ester and mineral oil. Roll forces, reductions and surface quality (brightness/smudge) for the Example 1 emulsion were equivalent to or better than traditional cold rolling emulsions, all of which contain fatty acids.

The foregoing examples are not limiting. Numerous other modifications and embodiments of my invention will occur to those skilled in the art without departing from the spirit and scope of the following claims.

What is claimed is:

1. A lubricant emulsion comprising
(a) about 90–98 wt % water, and
(b) about 2–10 wt % of a lubricant composition emulsified in the water, said composition comprising about 60–95 wt % mineral oil and about 5–40 wt % of an alkoxyalkyl ester having the formula $R_2COO(CH_2CH_2O)_nR_1$ wherein n=1 or 2, $R_1$ is a $C_1$ to $C_8$ alkyl group and $R_2$ is a $C_7$ to $C_{19}$ alkyl or alkenyl group.

2. The emulsion of claim 1 comprising about 3–7 wt % of the lubricant composition emulsified in about 93–97 wt % water.

3. The emulsion of claim 1 comprising about 5 wt % of the lubricant composition dispersed in about 95 wt % water.

4. The emulsion of claim 1 comprising about 65–75 wt % mineral oil and about 25–35 wt % of the ester.

5. The emulsion of claim 1 wherein $R_1$ is a $C_4$–$C_8$ saturated straight chain alkyl group.

6. The emulsion of claim 1 wherein $R_1$ is a butyl group.

7. The emulsion of claim 1 wherein $R_2$ is a $C_{11}$–$C_{17}$ straight chain alkyl or alkenyl group.

8. The emulsion of claim 1 wherein $R_2$ is a $C_{17}$ saturated alkyl or monounsaturated alkenyl group.

9. The emulsion of claim 1 wherein said alkoxyalkyl ester is selected from the group consisting of butoxyethyl stearate, butoxyethyl oleate, methoxyethyl stearate and methoxyethyl oleate.

10. The emulsion of claim 1 wherein said alkoxyalkyl ester is butoxyethyl stearate.

11. The emulsion of claim 1 further comprising
(c) less than about 10 wt % (based on the weight of the composition) of a $C_8$–$C_{40}$ mono- or dicarboxylic acid.

12. The composition of claim 11 wherein said acid comprises about 0.5–4 wt % of the composition.

13. The composition of claim 11 wherein said acid comprises about 3 wt % of the composition.

14. The composition of claim 12 wherein said acid comprises oleic acid.

15. The emulsion of claim 11 comprising about 65–75 wt % mineral oil and about 25–35 wt % of the ester.

16. A lubricant emulsion containing essentially no fatty acids, fatty acid esters or soaps and consisting essentially of
(a) about 90–98 wt % water, and
(b) about 2–10 wt % of a lubricant composition emulsified in the water, said composition comprising about 60–95 wt % mineral oil and about 5–40 wt % of an alkoxyalkyl ester having the formula $R_2COO(CH_2CH_2O)_nR_1$ wherein n=1 or 2, $R_1$ is a $C_1$ to $C_8$ alkyl group and $R_2$ is a $C_7$ to $C_{19}$ alkyl or alkenyl group.

17. A lubricant composition comprising
(a) about 60–95 wt % mineral oil,
(b) about 5–40 wt % of an alkoxyalkyl ester having the formula $R_2COO(CH_2CH_2O)_nR_1$ wherein n=1 or 2, $R_1$ is a $C_1$ to $C_8$ alkyl group and $R_2$ is a $C_7$ to $C_{19}$ alkyl or alkenyl group, and
(c) about 0.5–10 wt % of a $C_8$–$C_{40}$ mono- or dicarboxylic acid.

18. The composition of claim 17 wherein said ester is selected from the group consisting of butoxyethyl stearate, butoxyethyl oleate, methoxyethyl stearate and methoxyethyl oleate.

19. The composition of claim 17 wherein said acid comprises about 0.5–4 wt % of the composition.

20. The composition of claim 17 wherein said acid comprises oleic acid.

* * * * *